US008113278B2

(12) United States Patent
DeLaCroix et al.

(10) Patent No.: US 8,113,278 B2
(45) Date of Patent: Feb. 14, 2012

(54) SYSTEM AND METHOD FOR ENHANCED OIL RECOVERY USING AN IN-SITU SEISMIC ENERGY GENERATOR

(75) Inventors: Robert F. DeLaCroix, Penfield, NY (US); Dennis R Courtright, Canandaigua, NY (US)

(73) Assignee: Hydroacoustics Inc., Henrietta, NY (US)

( * ) Notice: Subject to any disclaimer, the term of this patent is extended or adjusted under 35 U.S.C. 154(b) by 3 days.

(21) Appl. No.: 12/368,779

(22) Filed: Feb. 10, 2009

(65) Prior Publication Data

US 2009/0200019 A1 Aug. 13, 2009

Related U.S. Application Data

(60) Provisional application No. 61/027,573, filed on Feb. 11, 2008.

(51) Int. Cl.
*E21B 28/00* (2006.01)

(52) U.S. Cl. ..... 166/249; 166/177.1; 166/177.2

(58) Field of Classification Search ..... 166/69, 166/177.1, 177.2, 249, 266
See application file for complete search history.

(56) References Cited

U.S. PATENT DOCUMENTS

| | | | | |
|---|---|---|---|---|
| 2,670,801 | A | 3/1954 | Shelborne | |
| 3,209,834 | A * | 10/1965 | Essary | 166/177.2 |
| 3,520,362 | A * | 7/1970 | Galle | 166/249 |
| 3,653,460 | A | 4/1972 | Chelminski | |
| 3,897,836 | A | 8/1975 | Hall | |
| 3,952,800 | A | 4/1976 | Bodine | |
| 3,958,647 | A | 5/1976 | Chelminski | |
| 3,965,982 | A | 6/1976 | Medlin | |
| 3,970,146 | A | 7/1976 | Keenan | |
| 3,986,555 | A | 10/1976 | Robertson | |
| 3,990,512 | A | 11/1976 | Kuris | |
| 3,997,021 | A | 12/1976 | Chelminski | |
| 4,007,805 | A | 2/1977 | Reber | |
| 4,016,952 | A | 4/1977 | Reed et al. | |
| 4,022,275 | A | 5/1977 | Brandon | |
| 4,038,630 | A | 7/1977 | Chelminski | |
| 4,047,581 | A | 9/1977 | Erickson | |
| 4,049,053 | A | 9/1977 | Fishers | |
| 4,074,758 | A | 2/1978 | Scott | |
| 4,084,638 | A | 4/1978 | Whiting | |
| 4,108,271 | A | 8/1978 | Chelminski | |
| 4,114,689 | A | 9/1978 | Dismukes | |

(Continued)

FOREIGN PATENT DOCUMENTS

CA 2232948 6/2005

(Continued)

OTHER PUBLICATIONS

JPT Online; Technology Update: Value of in-Situ Seismic Waves—Regain Lost Reserves, Increase Oil Cut; © 2003, Society of Petroleum Engineers.

(Continued)

*Primary Examiner* — Brad Harcourt
(74) *Attorney, Agent, or Firm* — Duane C. Basch; Basch & Nickerson LLP

(57) ABSTRACT

Disclosed is a system and method for enhanced oil recovery using at least one in-situ seismic energy generator for generating seismic acoustic waves. More particularly the system and method employ a downhole electro-hydraulic seismic pressure wave source to enhance the recovery of oil from reservoirs.

5 Claims, 9 Drawing Sheets

U.S. PATENT DOCUMENTS

| | | | | |
|---|---|---|---|---|
| 4,163,580 | A | 8/1979 | Pearson | |
| 4,164,978 | A | 8/1979 | Scott | |
| 4,169,503 | A | 10/1979 | Scott | |
| 4,185,714 | A | 1/1980 | Pascouet et al. | |
| 4,210,222 | A | 7/1980 | Chelminski | |
| 4,234,052 | A | 11/1980 | Chelminski | |
| 4,240,518 | A | 12/1980 | Chelminski | |
| 4,252,189 | A | 2/1981 | Bodine | |
| 4,257,482 | A | 3/1981 | Kompanek | |
| 4,271,924 | A | 6/1981 | Chelminski | |
| 4,280,557 | A | 7/1981 | Bodine | |
| 4,280,558 | A | 7/1981 | Bodine | |
| 4,300,653 | A | 11/1981 | Cao et al. | |
| 4,303,141 | A | 12/1981 | Pascouet | |
| 4,305,463 | A | 12/1981 | Zakiewiez | |
| 4,305,464 | A | 12/1981 | Masszi | |
| 4,316,521 | A | 2/1982 | Chelminski | |
| 4,323,119 | A | 4/1982 | Bodine | |
| 4,342,364 | A | 8/1982 | Bodine | |
| 4,343,356 | A | 8/1982 | Riggs | |
| 4,344,903 | A | 8/1982 | Pascouet | |
| 4,345,650 | A | 8/1982 | Wesley | |
| 4,377,355 | A | 3/1983 | Chelminski | |
| 4,383,582 | A | 5/1983 | Chelminski | |
| 4,393,830 | A | 7/1983 | Bodine | |
| 4,407,365 | A | 10/1983 | Cooke | |
| 4,417,621 | A | 11/1983 | Medlin | |
| 4,429,743 | A | 2/1984 | Bodine | |
| 4,432,078 | A | 2/1984 | Silverman | |
| 4,437,518 | A | 3/1984 | Williams | |
| 4,469,175 | A | 9/1984 | Massa | |
| 4,471,838 | A | 9/1984 | Bodine | |
| 4,479,680 | A | 10/1984 | Wesley | |
| 4,509,593 | A | 4/1985 | Traver | |
| 4,512,401 | A | 4/1985 | Bodine | |
| 4,512,402 | A | 4/1985 | Kompanek | |
| 4,544,031 | A | 10/1985 | Bodine | |
| 4,548,281 | A | 10/1985 | Bodine | |
| 4,594,697 | A | 6/1986 | Pascouet | |
| 4,596,231 | A | 6/1986 | Chelminski | |
| 4,599,712 | A | 7/1986 | Chelminski | |
| 4,608,675 | A | 8/1986 | Chelminski | |
| 4,648,449 | A | 3/1987 | Harrison | |
| 4,658,897 | A | 4/1987 | Kompanek | |
| 4,665,980 | A | 5/1987 | Bodine | |
| 4,673,037 | A | 6/1987 | Bodine | |
| 4,674,571 | A | 6/1987 | Vogen | |
| 4,679,627 | A | 7/1987 | Harrison | |
| 4,702,315 | A * | 10/1987 | Bodine | 166/249 |
| 4,712,202 | A | 12/1987 | Chelminski | |
| 4,712,641 | A | 12/1987 | Chelminski | |
| 4,716,555 | A | 12/1987 | Bodine | |
| 4,722,417 | A | 2/1988 | Selsam | |
| 4,723,230 | A | 2/1988 | Chelminski | |
| 4,733,382 | A | 3/1988 | Pascouet | |
| 4,735,281 | A | 4/1988 | Pascouet | |
| 4,754,443 | A | 6/1988 | Chelminski | |
| 4,775,016 | A | 10/1988 | Barnard | |
| 4,779,245 | A | 10/1988 | Chelminski | |
| 4,788,467 | A | 11/1988 | Plambeck | |
| 4,817,712 | A | 4/1989 | Bodine | |
| 4,830,111 | A | 5/1989 | Jenkins | |
| 4,852,071 | A | 7/1989 | Otto | |
| 4,858,205 | A | 8/1989 | Harrison | |
| 4,858,718 | A | 8/1989 | Chelminski | |
| 4,862,990 | A | 9/1989 | Cole | |
| 4,875,545 | A | 10/1989 | Pascouet | |
| 4,884,634 | A | 12/1989 | Ellingsen | |
| 4,921,068 | A | 5/1990 | Pascouet | |
| 4,939,704 | A | 7/1990 | Chelminski | |
| 4,945,986 | A | 8/1990 | Hardin | |
| 4,949,315 | A | 8/1990 | Pascouet | |
| 4,976,333 | A | 12/1990 | Pascouet | |
| 4,997,044 | A | 3/1991 | Stack | |
| 5,001,679 | A | 3/1991 | Harrison | |
| 5,004,050 | A | 4/1991 | Sizonenko | |
| 5,009,272 | A | 4/1991 | Walter | |
| 5,018,115 | A | 5/1991 | Pascouet | |
| 5,101,899 | A | 4/1992 | Hoskins | |
| 5,105,880 | A | 4/1992 | Shen | |
| 5,109,698 | A | 5/1992 | Owen | |
| 5,109,922 | A | 5/1992 | Joseph | |
| 5,128,907 | A | 7/1992 | Pascouet | |
| 5,139,087 | A | 8/1992 | Hutchins | |
| 5,144,596 | A | 9/1992 | Pascouet | |
| 5,184,678 | A | 2/1993 | Pechkov et al. | |
| 5,190,114 | A | 3/1993 | Walter | |
| 5,229,554 | A | 7/1993 | Cole | |
| 5,282,508 | A | 2/1994 | Ellingsen | |
| 5,321,213 | A | 6/1994 | Cole et al. | |
| 5,351,754 | A | 10/1994 | Hardin | |
| 5,361,837 | A | 11/1994 | Winbow | |
| 5,375,539 | A | 12/1994 | Rippberger | |
| 5,377,753 | A | 1/1995 | Haberman | |
| 5,396,955 | A | 3/1995 | Howlett | |
| 5,420,829 | A | 5/1995 | Pascouet | |
| 5,432,757 | A | 7/1995 | Chelminski | |
| 5,515,918 | A | 5/1996 | Brett | |
| 5,572,486 | A | 11/1996 | Landro et al. | |
| 5,582,247 | A | 12/1996 | Brett | |
| 5,586,602 | A | 12/1996 | Vagin | |
| 5,592,440 | A | 1/1997 | Harrison | |
| 5,597,265 | A | 1/1997 | Gallo | |
| 5,615,170 | A | 3/1997 | Chelminski | |
| 5,628,365 | A | 5/1997 | Belonenko | |
| 5,646,910 | A | 7/1997 | Bouyoucos | |
| 5,660,231 | A | 8/1997 | Belonenko | |
| 5,725,329 | A | 3/1998 | Chelminski | |
| 5,727,628 | A | 3/1998 | Patzner | |
| 5,824,214 | A | 10/1998 | Paul | |
| 5,825,719 | A | 10/1998 | Harrison, Jr. | |
| 5,826,653 | A | 10/1998 | Rynne | |
| 5,836,389 | A | 11/1998 | Wagner | |
| 5,841,733 | A | 11/1998 | Bouyoucos et al. | |
| 5,896,938 | A | 4/1999 | Moeny | |
| 5,950,726 | A | 9/1999 | Roberts | |
| 5,980,148 | A | 11/1999 | Pascouet | |
| 5,984,578 | A | 11/1999 | Hanesian | |
| 6,012,521 | A | 1/2000 | Zunkel | |
| 6,015,010 | A | 1/2000 | Kostrov | |
| 6,059,031 | A | 5/2000 | Brett | |
| 6,116,515 | A | 9/2000 | Chelminski | |
| 6,185,156 | B1 | 2/2001 | Bouyoucos | |
| 6,186,228 | B1 | 2/2001 | Wegener et al. | |
| 6,227,293 | B1 | 5/2001 | Huffman et al. | |
| 6,230,799 | B1 | 5/2001 | Slaughter et al. | |
| 6,241,019 | B1 | 6/2001 | Davidson et al. | |
| 6,247,533 | B1 | 6/2001 | Brett | |
| 6,250,386 | B1 * | 6/2001 | Ellingsen | 166/249 |
| 6,250,388 | B1 | 6/2001 | Carmi | |
| 6,279,653 | B1 | 8/2001 | Wegener | |
| 6,286,612 | B1 | 9/2001 | Pascouet | |
| 6,318,471 | B1 | 11/2001 | Raines | |
| 6,321,836 | B2 | 11/2001 | Brett | |
| 6,328,102 | B1 | 12/2001 | Dean | |
| 6,364,569 | B1 | 4/2002 | Pascouet | |
| 6,390,191 | B1 | 5/2002 | Melson et al. | |
| 6,405,796 | B1 | 6/2002 | Meyer | |
| 6,405,797 | B2 | 6/2002 | Davidson et al. | |
| 6,460,618 | B1 | 10/2002 | Braithwaite | |
| 6,464,035 | B1 | 10/2002 | Chelminski | |
| 6,467,542 | B1 | 10/2002 | Kostrov et al. | |
| 6,491,095 | B2 | 12/2002 | Kompanck | |
| 6,499,536 | B1 | 12/2002 | Ellingsen | |
| 6,533,035 | B2 | 3/2003 | Troutt | |
| 6,550,534 | B2 | 4/2003 | Brett | |
| 6,595,285 | B2 | 7/2003 | Dubois | |
| 6,619,394 | B2 | 9/2003 | Soliman et al. | |
| 6,643,221 | B1 | 11/2003 | Hsu et al. | |
| 6,691,778 | B2 | 2/2004 | Cole et al. | |
| 6,705,396 | B1 | 3/2004 | Ivannikov et al. | |
| 6,715,551 | B2 | 4/2004 | Curtis et al. | |
| 6,725,923 | B1 | 4/2004 | Ivannikov et al. | |
| 6,736,209 | B2 | 5/2004 | Ivannikov et al. | |
| 6,747,914 | B2 | 6/2004 | Aronstam | |
| 6,814,141 | B2 | 11/2004 | Huh et al. | |
| 6,845,818 | B2 | 1/2005 | Tutuncu et al. | |

| | | | | |
|---|---|---|---|---|
| 6,851,473 | B2 | 2/2005 | Davidson | |
| 6,866,098 | B1 | 3/2005 | Arndt et al. | |
| 6,899,175 | B2 * | 5/2005 | Kostrov et al. | 166/249 |
| 6,907,927 | B2 | 6/2005 | Zheng et al. | |
| 6,959,760 | B1 | 11/2005 | Braithwaite et al. | |
| 6,994,167 | B2 | 2/2006 | Ramos et al. | |
| 7,059,591 | B2 | 6/2006 | Bortkevitch et al. | |
| 7,063,144 | B2 | 6/2006 | Abramov et al. | |
| 7,213,681 | B2 | 5/2007 | Birchak et al. | |
| 7,216,738 | B2 | 5/2007 | Birchak et al. | |
| 7,273,099 | B2 | 9/2007 | East, Jr. et al. | |
| 7,405,998 | B2 | 7/2008 | Webb et al. | |
| 2001/0050173 | A1 * | 12/2001 | Head | 166/381 |
| 2005/0189108 | A1 | 9/2005 | Davidson | |
| 2005/0284625 | A1 * | 12/2005 | Rodney et al. | 166/250.01 |
| 2007/0045038 | A1 | 3/2007 | Han | |
| 2008/0302528 | A1 * | 12/2008 | Samaroo et al. | 166/249 |

FOREIGN PATENT DOCUMENTS

| | | |
|---|---|---|
| CA | 2502800 | 9/2005 |
| EP | 0335543 | 10/1989 |

OTHER PUBLICATIONS

1998 Natural Gas and Oil Technology Partnership Continuation Proposal; Seismic Stimulation for Enhanced Production of Oil Reservoirs; Contact Peter Roberts.

Forbis, Patrick C., ed.; Texas Drilling Observer; Apr. 15, 2005.

Oil & Gas—Maximising Recovery Programme (formerly SHARP) IOR Views; Good Vibrations: Application of Acoustic Waves for Reservoir Stimulation; Issue 8, May 2004.

Paulsson; 4aEA4 Development of an advanced vibratory source for borehole seismology; ASA 134th Meeting, San Diego, CA Dec. 1997.

Roberts; An Integrated Approach to Assessing Seismic Stimulation of Oil Reservoirs; DOE/Industry Cooperative Research; The Confluence of New Technologies and Old Shows, Fields and Plays: Case Histories 2003 Mid-Continent Section Meeting Technical Program.

Seismic Shock Shakes World Oil Industry; Applied Seismic Research Corp. Introduces Hydro-Impact Technology.

Seismic Stimulation for Enhanced Production of Oil Reservoirs; The Geophysics Group; EES-11 Programs—Seismic Reservoir Stimulation ees.1an1.gov/EES4/stimulation.

Roberts; Seismic Stimulation for Enhanced Production of Oil Reservoirs; EES Progress Report (EES-11) 97seismic_169.

Technology Update: Value of in-Situ Seismic Waves—Regain Lost Reserves, Increase Oil Cut; JPT (Apr. 2005).

Kostrov et al.; In situ seismic stimulation shows promise for revitalizing mature fields; Oil & Gas Journal, Apr. 18, 2005.

Beresnev et al.; Electric-wave stimulation of oil production: a review of methods and results; Geophysics, vol. 59, No. 6 (Jun. 1994); p. 1000-1017.

Chilingar et al.; Seismic Techniques of Enhanced Oil Recovery: Experimental and Field Results; ppt.

Roberts et al.; Elastic wave stimulation of oil reservoirs; The Leading Edge; May 2003; v. 22; No. 5; p. 448-453; © 2003 Society of Exploration Geophysicists; GeoScienceWorld.

Jackson; Advances in Seismic Stimulation Technologies; PTTC Network News vol. 7. No. 2, 2001.

Jackson; Advances in Seismic Stimulation Technologies; PTTC Network News vol. 7. No. 2, 2001, more.

* cited by examiner

SYSTEM AND METHOD FOR ENHANCED OIL RECOVERY USING AN IN-SITU SEISMIC ENERGY GENERATOR

This application hereby claims priority from U.S. Provisional Application 61/027,573 for a "SYSTEM AND METHOD FOR ENHANCED OIL RECOVERY USING AN IN-SITU SEISMIC ENERGY GENERATOR," by R. DeLaCroix et al., filed Feb. 11, 2008, which is hereby incorporated by reference in its entirety.

The disclosed systems and methods are directed to generating acoustic waves, and more particularly a downhole electro-hydraulic seismic source to enhance oil recovery. The systems and methods disclosed herein enhance oil recovery by means of elastic-wave vibratory stimulation, for example, to diminish capillary forces and encourage the rate of migration and coalescence of retained oil within the porous media of an oil reservoir.

BACKGROUND AND SUMMARY

After an oil well has been in operation for a time, its productivity often diminishes to a point at which the operation of the well is marginal or economically unfeasible. It is frequently the case, however, that substantial quantities of crude oil remain in the ground in the regions of these unproductive wells but cannot be liberated by conventional techniques. Therefore, it is desirable to provide methods for efficiently increasing the productivity of a well, provided it can be done economically. By way of definition the common meaning of borehole is merely a hole that is drilled into the surface of the earth, however once encased forms a production oil well for the purpose of extracting hydrocarbons. Notably, a borehole can serve as an injection or monitor well and in the case of the present invention allows for the insertion of a down hole seismic pressure wave generator.

A multiplicity of methods have been discovered for improving the oil recovery efficiency, yet large volumes of hydrocarbons remain in the oil rich formation after secondary, or even tertiary recovery methods have been practiced. It is believed that a major factor causing the retention of the hydrocarbons in the formation is the inability to direct sufficient pressure forces on the hydrocarbon droplets residing in the pore spaces of the matrix formation. Conventional oil recovery is accomplished in a two tier process, the primary or initial method is reliant on the natural flow or pumping of the oil within the well bore until depletion, once the free flowing oil has been removed a secondary means is required—where an immiscible fluid, such as water, is forced into an injection borehole to flush the oil contained within the strata into a production well. In the past it has not been cost effective to employ tertiary or enhanced oil recovery (also referred to as EOR) methods, albeit up to seventy percent of the total volume of oil may still remain in an abandoned oil well after standard oil recovery techniques are used.

Another technique that has been employed to increase the recovery of oil employs low frequency vibration energy. Low frequency vibration from surface or downhole sources has been used to influence liquid hydrocarbon recoveries from subterranean reservoirs. This type of vibration, at source-frequencies generally less than 1 KHz, has been referred to in the literature as sonic, acoustic, seismic, p-wave, or elastic-wave well stimulation. For example, stimulation by low frequency vibration has been effectively utilized in some cases in Russia to improve oil production from water flooded reservoirs. Examples from the literature also suggest that low frequency stimulation can accelerate or improve ultimate oil recovery. Explanations for why low frequency stimulation makes a difference vary widely, however, it is understood that the vibration causes the coalescence of oil droplets to re-establish a continuous oil phase due to the dislodging of oil droplets. Additionally it is believed that the sound waves reduce capillary forces by altering surface tensions and interfacial tensions and thereby free the droplets and/or enable them to coalesce. For example, U.S. Pat. No. 5,184,678 to Pechkov et al. issued Feb. 9, 1993 discloses a method and apparatus for stimulating fluid production in a producing well utilizing an acoustic energy transducer disposed in the well bore within a producing zone. However, Pevhkov only teaches that ultrasonic irradiating removes fines and decreases the well fluid viscosity in the vicinity of the perforations by agitation, thereby increasing fluid production from an active well.

Ultrasonic waves can improve and/or accelerate oil production from porous media. The problem with ultrasonic waves is that in general, the depth of penetration or the distance that ultrasonic waves can move into a reservoir from a source is limited to no more than a few feet, whereas low frequency or acoustic waves can generally travel hundreds to thousands of feet through porous rock. While sonic stimulation methods and apparatus to improve liquid hydrocarbon flow have achieved some success in stimulating or enhancing the production of liquid hydrocarbons from subterranean formations, the acoustic energy transducers used to date have generally lacked sufficient acoustic power to provide a significant pulsed wave. Thus, there remains a continuing need for improved methods and apparatus, which utilize sonic energy to stimulate or enhance the production of liquid hydrocarbons from subterranean formations. Acoustic energy is emitted from the acoustic energy transducer in the form of pressure waves that pass through the liquid hydrocarbons in the formation so that the mobility of the liquid hydrocarbon is improved and flow more freely to the well bore. By way of definition an elastic-wave is a specific type of wave that propagates within elastic or visco-elastic materials. The elasticity of the material provides the propagating force of the wave and when such waves occur within the earth they are generally referred to as seismic waves.

The increasing value of a barrel of oil and the increased demand for oil has created a greater interest in tertiary enhanced oil recovery methods to further oil availability by the revitalization of older wells, including those that have been abandoned due to a high ratio of water compared to the volume of total oil produced, or commonly called the water cut. The primary intent of enhanced oil recovery is to provide a means to encourage the flow of previously entrapped oil by effectively increasing the relative permeability of the oil embedded formation and reducing the viscosity and surface tension of the oil. Numerous enhanced oil recovery technologies are currently practiced in the field including thermodynamics, chemistry and mechanics. Three of these methods have been found to be commercially viable with varying degrees of success and limitations. Heating the oil with steam has proven be an effective means to reduce the viscosity, provided there is ready access to steam energy, and accounts for over half of the oil currently recovered. The use of chemical surfactants and solvents, such as $CO_2$, to reduce the surface tension and viscosity, while effective, are not widely used due to cost, contamination and environmental concerns. However, seismic stimulation lacks any of the aforementioned limitations and is therefore being further explored as a viable enhanced oil recovery technique.

The vibration of reservoir rock formations is thought to facilitate enhanced oil recovery by (i) diminishing capillary forces, (ii) reducing the adhesion between rocks and fluids, and (iii) causing coalescence of the oil droplets to enable them to flow within the water flood. Recent studies at the Los Alamos National Laboratory conducted by Peter Roberts have indicated that this process can increase oil recovery over substantially large areas of a reservoir at a significant lower cost than any other enhanced oil recovery stimulation method. Accordingly, the systems and methods disclosed herein provide a low-cost tertiary solution for the reclamation of oil that had previously been uneconomical to retrieve. It is, therefore, a general object of the present disclosure to characterize downhole vibratory seismic sources capable of generating elastic-wave vibration stimulation within a previously abandoned oil field in order to extract the immobile oil. More specifically, by employing an apparatus for generating acoustic waves, oil recovery is stimulated within an oil deposit in fluid contact with a borehole into which the acoustic wave source can be placed. In one embodiment, the apparatus comprises: an elongated and generally cylindrical housing suitable for passing through a borehole, an accumulator; a pump, an energy transfer section, and a pressure transfer valve, wherein the pump pressure is stored within said accumulator and subsequently transferred, thereby releasing acoustic wave energy into the fluid surrounding the apparatus.

Accordingly, disclosed in embodiments herein is a system for imparting seismic wave energy within an oil reservoir in the form of a P-wave, having a controlled acoustic frequency, so as to alter the capillary forces of the residual oil.

In one embodiment herein there is disclosed a method for the controlled release of highly pressurized ambient fluids through opposed orifices of a rotary valve. As an alternative or additional configuration, seismic energy may be mechanically released by means of a dynamic isotropic transducer having a radial surface consisting of a plurality of adjacent longitudinal surfaces that are concurrently displaced by means of an associated set of radially configured pistons.

It is therefore an objective of the embodiments to provide a system for stimulating wells to increase the pressure and improve the flow of crude oil into the casings. It is a further object to provide an effective technique for removing deposits that clog the perforations of the oil well casing. It is yet another object of the disclosed embodiments to provide an apparatus wherein the resultant vibrational energy from the wave pulse generator is developed within the down hole apparatus by converting electro or mechanical-energy delivered from the surface into hydraulic energy. It is a still further object of the disclosed embodiments to provide such apparatus wherein a plurality of wave pulse generators may be controlled in a synchronized manner so as to provide a broad wave front and to thereby maximize the energy transfer within the oil strata. Other objects and advantages of the disclosed systems and methods will become apparent from a consideration of the following detailed description taken in conjunction with the accompanying drawings.

The various embodiments described herein are not intended to limit the embodiments described. On the contrary, the intent is to cover all alternatives, modifications, and equivalents as may be included within the spirit and scope of the disclosure and appended claims.

DETAILED DESCRIPTION

Figure 1:
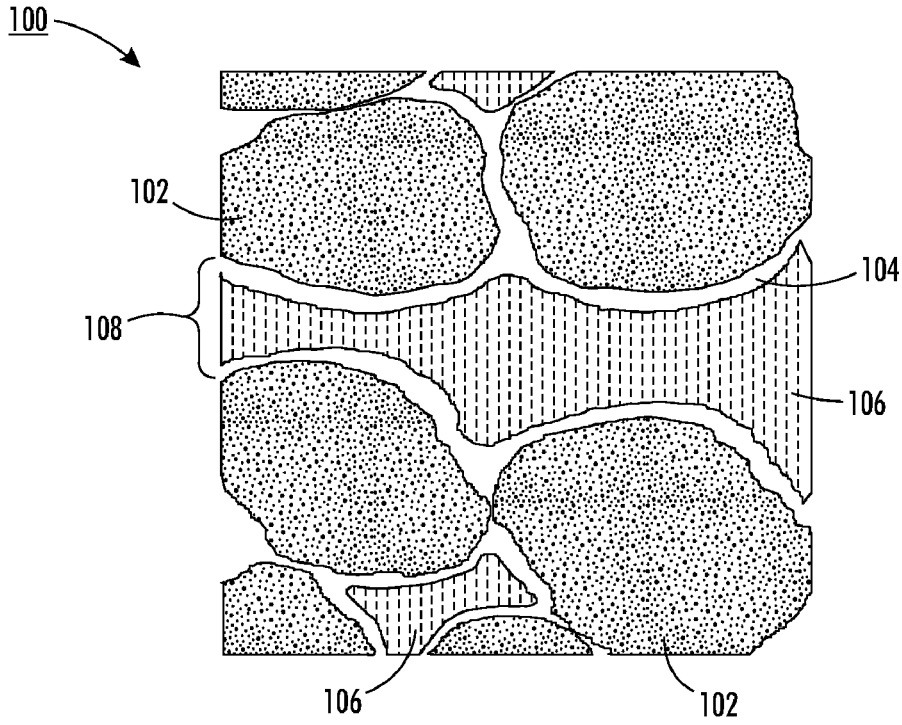
FIG. 1 is a cross-sectional diagram depicting a porous medium having a fluid therein.
Figure 2:
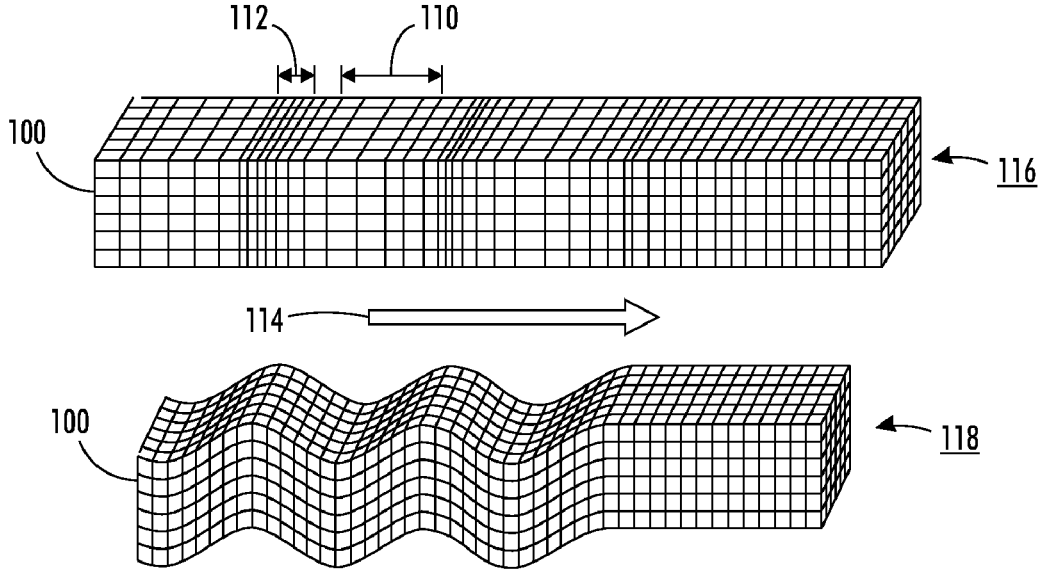
FIG. 2 is an exemplary representation of waves.

In the context of this specification, porous medium 100 may be a natural earth material comprising a solid matrix and an interconnected pore system within the matrix as shown in FIG. 1. The solid matrix 102 comprises geological materials including gravel, sand, clay, sandstone, limestone and other sedimentary rock formations, as well as fractured rocks which have both divisions and pores through which fluids may flow. The pores within the solid matrix are open to each other and typically contain water, oil or both, wherein a pressure can be applied, thereby causing a fluid flow to take place through the pores. The porosity of a porous medium 100 is the ratio of the volume of open space in the pores to the total volume of the medium. Porous media can be further characterized by a permeability, that being the average measure of the geometric volume of the pores, which is directly related to the flow rate of fluids through the medium 100 under the effect of an induced pressure force from a pressure P-wave 116 as seen in FIG. 2. P waves are compression-type sound waves that alternately compress 112 and dilate 110 media 100 in the direction of propagation 114, for example, within an oil well reservoir.

In solid matrix 102 P-waves generally travel slightly less than 16.5K ft/s as compared to 5K ft/s in liquid 106 within pores 108. On the other hand S-waves 118 or shear waves displace solid matrix 102 perpendicularly to the direction of propagation. However, unlike P-waves, S-waves can travel only through solids, as fluids do not support shear stresses. Flow takes place in porous medium 100 by generating a pressure gradient in the fluid, in other words by creating spatial differences in the fluid pressures. Porous medium 100, as seen in FIG. 1, contains two non-miscible fluids, oil 106, for example, and water 104, for example, where the fluid wetting region (also 104) is the result of the surface tension and wettability effect of the water that provides for a direct contact with the majority of the solid material and thereby covering the wall surfaces of flow channels 108. As seen in FIG. 1, oil 106 lies in the interstices, pores or channels 108 of media 100 and is separated from the solid matrix 102 by the water wetting region 104.

The porosity of porous medium 100 can be expressed as the ratio of the volume of flow channels 108 to the total volume of medium 100. Formations of practical interest for enhanced oil recovery techniques typically have porosities that lie in the approximate range of twenty to fifty percent porosity. Porous media 100 is further characterized by a permeability. Permeability is an average measurement of pore properties, such as the geometry of flow channels 108, which depict the flow rate of liquid 106 through medium 100 under the effect of the pressure gradient force caused by the disclosed systems within the solid-fluid medium.

Pressure pulsing is an induced variation of the fluid pressure in porous medium 100 through the introduction of a force into the fluid(s) 104 and/or 106. The pressure source may be periodic or intermittent, as well as episodic, and it may be applied at the point of the extraction (oil well) or at various boreholes within the region of porous medium 100 that is able to be stimulated by the pressure wave.

There are theoretical mechanisms to explain the changes in fluid flow characteristics within porous medium resulting from seismic pressure, pulsing stimulation including changes in wettability, viscosity, surface tension and relative permeability. Additionally, it has been determined that suspended oscillating droplets of oil are induced to coalescence in response to seismic energy, which thereby enables gravitational flow within medium 100.

Figure 3:
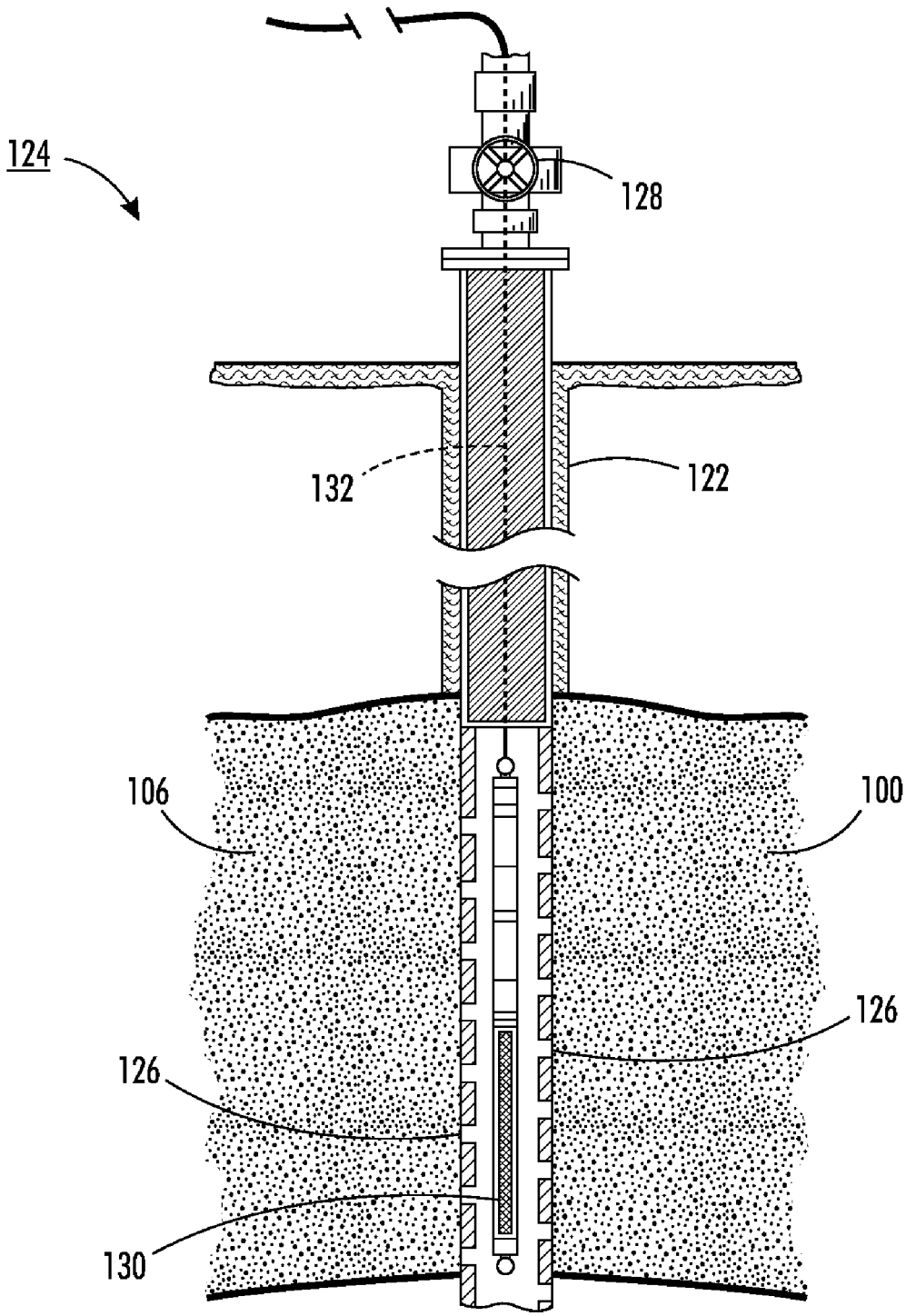
FIG. 3 illustrates the various aspects of an oil well having an acoustic seismic generator therein.

As more particularly set forth below, the disclosed systems and methods are directed to the transfer of a pressure wave into a subterranean porous media 100 adjacent to oil or other well 124. Referring to FIG. 3 seismic energy generator 130 is lowered through casing 122 of oil well 124 until it is submerged within the oil producing region or is otherwise fluidly coupled thereto. Casing 122 has perforations 126, typically in the form of vertically elongated slots, through which fluid(s) 104 and/or 106 (or more likely a combination of oil and other fluids such as water) from the surrounding porous media 100 enters the casing where a pump (not shown) levitates it upwardly through casing 122 to valve 128. The structure and features of the well itself are conventional and, although not shown or described in detail in FIG. 3, are well known to those skilled in the art of oil wells and oil extraction.

Alternatively, the seismic energy generator 130 may be placed below the end of the casing. For example, if a borehole is drilled, a casing may be inserted into a portion of the bore hole, or maybe all of it, and concrete is pored along a portion of the outside of the casing, but the casing does not necessarily go all the way to the bottom of the borehole. In other words, the disclosed seismic energy generator 130 can be below the level of the casing and does not require contact with the casing and does not need to transmit through the casing and the concrete. Placing the seismic energy generator 130 beneath the level of the casing may significantly improve the performance of the generator and decrease the attenuation of any energy waves or pulses emanating therefrom.

Figure 4:
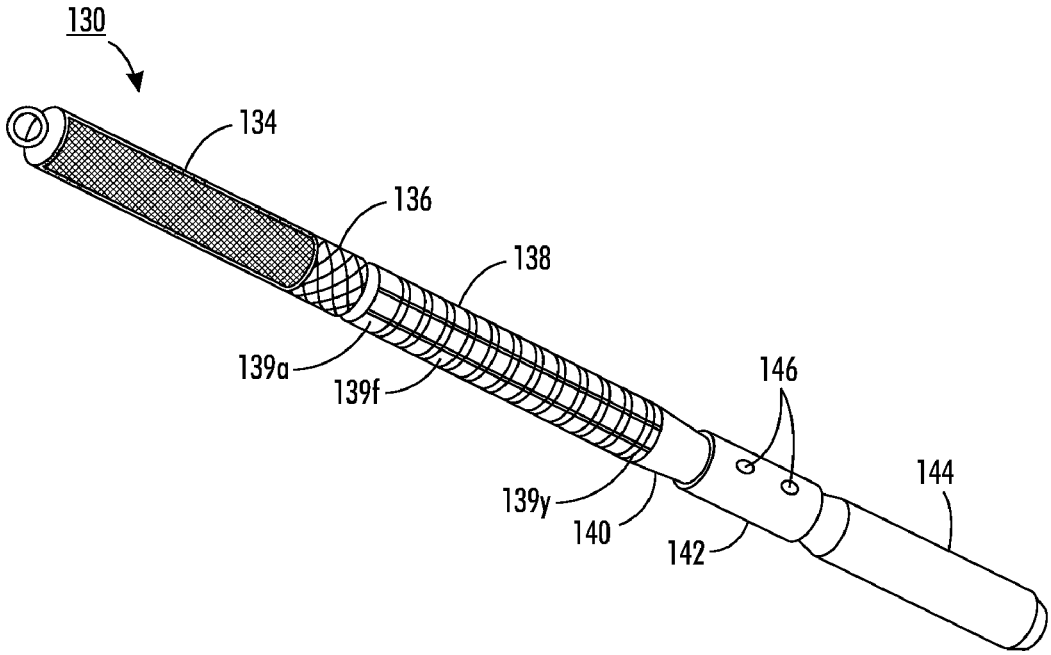
FIG. 4 is a view of a rotary valve seismic wave generator.

Now referring to FIG. 4, seismic energy generator 130 is shown having motor 134 driving a fluid pump 138, which acquires ambient fluid from intake 136, pressurizes and stores the fluid in accumulator 144. Motor 134 may be a conventional submersible well motor having a power rating in the range of 15-40 horse power and a cylindrical profile so as to fit within the borehole. Fluid pump 138 may also be a conventional submersible multi-stage (e.g., about 30 stages 139*a*-139*v*) centrifugal pump having a plurality of impellers on a common shaft within the same pump housing, that will readily pass inside of a borehole. The series of impellers initially intakes the surrounding fluid at the downhole ambient pressure through filter intake 136 and progressively increases the head pressure from impeller to impeller to a final discharge pressure of about 550 to about 650 psi above the ambient pressure, preferably at about 605 psi, at a flow rate of between 30-40 gpm and in one embodiment about 37 gpm. In one example, to produce about 600 psi at about 35 gpm requires approximately 12.25 fluid horsepower (h.p.), and with a fifty percent efficiency would require about a 25 h.p. motor. The output from pump 138 is stored in accumulator 144 and ultimately delivered to, and modulated by, rotary valve 142 to produce acoustic pressure waves into porous media 100, thereby causing the flow of entrapped oil within the oil reservoir.

In one exemplary embodiment, the fluid power of the pump, as stored in the accumulator may be on the order of about 200 to about 550 psi above ambient. In operation, the fluid pump 138 preferably operates in an optimal portion of its fluid-power curve (pressure vs. flow). In operation, when the ports of the rotary valve 142 are closed, a pressure of say about 550 psi above ambient may be created, and when the ports are opened, the pressure in the accumulator is released and would drop to a lower level of say about 200 psi above ambient.

Figure 5:
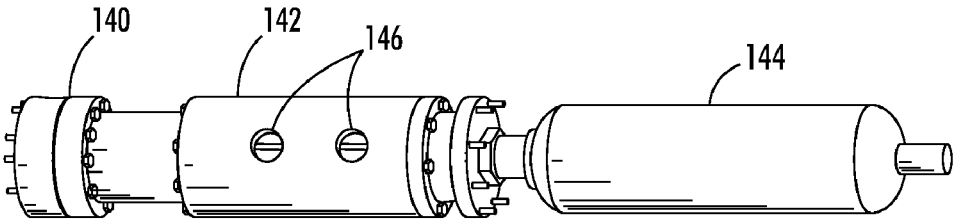
FIG. 5 is an enlarged view of the rotary valve of FIG. 4.
Figure 6:
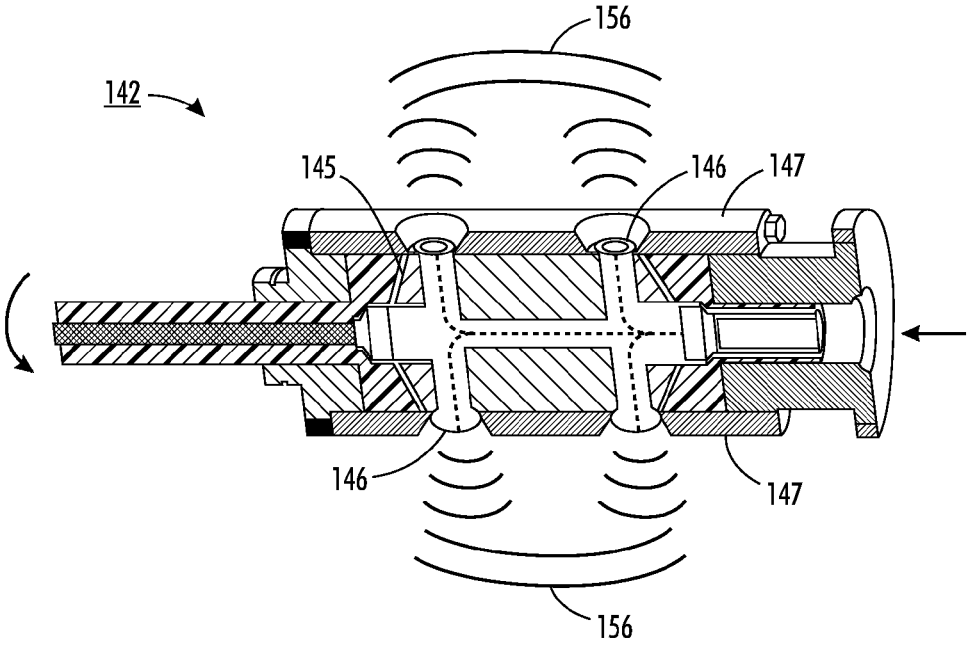
FIG. 6 is a cross sectional view of the rotary valve of FIG. 5.
Figure 7:
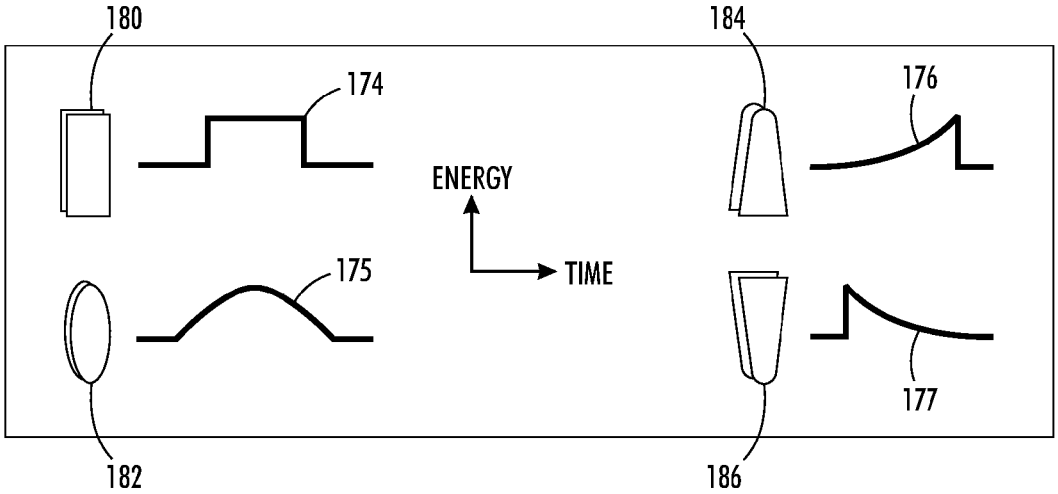
FIG. 7 is an illustration of various rotary port geometry.

More specifically, as shown in FIGS. 5-7, rotary valve 142 is driven by a second motor 140 causing rotor 145 to turn within the cylindrical cavity of stator 147. Rotational energy for valve 142 may be derived by using a hydraulic motor having a fluid connection to the output pressure of pump 138, or an electric motor, such as a DC, stepper or servo connected directly to rotor 145. In the alternative a common motor, having a transmission, could be used to drive both pump 138 and valve 142. Each of the aforementioned rotational driving means have specific advantages, as well as limitations, which are readily apparent to those skilled in the art. However, the criteria for the preferred design are packaging and speed control. Additionally, an input energy source from the surface for the acoustic source generator 130 can be delivered by power transmission line 132 within the borehole as pressure or electrical energy. In the case of pressure energy, either fluid or gas, the pressurized flow would be used to drive a turbine that would in turn either drive a DC electrical generator or directly drive pump 138 and/or valve 142. The prospect of using a surface pressure source may allow for improved control by providing the ability to disconnect the acoustic source from the surface. In summary, motor 140 controls rotation of the rotor 145 thereby producing acoustic pulsations at a desired frequency, and at a desired pressure as determined by control of the pump.

Now turning to FIG. 6, during the revolution of rotor 145, ports 146 become aligned with the shaped orifices of stator 147 and thereby directly releasing the pressure/flow stored within accumulator 144 into porous media 100. Pressure wave 156, as seen in FIG. 6, is transmitted twice for each revolution in the embodiment depicted, thereby the root frequency is determined to be equal to the number of ports about the circumference times the rotations per minute (RPM) of motor 140. The optimum frequency tends to be somewhat less than 1 KHz but greater than 5 Hz. It is also apparent that to further alter the frequency more or fewer ports and/or orifices can be included. In one embodiment, the generator may include a specific port profile within the rotor/stator set, whereby various energy profiles are produced in response to the manner in which the rotor and stator orifice profiles align with one another. The energy dissipation profile of wave 156 as further shown in FIG. 7 is dependent on at least four fundamental factors: (i) relative geometric shape of the stator/rotor ports 146 and 147, (ii) rotational speed of rotor 145, (iii) the dwell angle, and (iv) head pressure.

In the case of port geometry, rectangular orifice 180 tends to release pressure as a binary function as represented by waveform 174 and substantial harmonics thereof (not shown). For example, if a 5 Hz pulse pattern is produced, harmonics of 10, 20, 40, . . . Hz are also likely to be produced, and the shape of the opening may be varied to change the harmonic content and the nature of the pulse. The oval port 182 provides a more analog energy/time functional relationship as shown in waveform 175 having minimal harmonics. Furthermore, a combination of 180 and 182, as seen in orifice design 184 and 186 will exhibit a sharp "off" preceded by an increasing integrated energy curve as shown in orifice 184 and graph 176, or in the alternative a sharp "on" followed by decreasing integrated energy as seen in graph 177. This capability to "tune" the apertures by controlling the relative geometric opening created by the rotational alignment of the rotor and stator of the generator provides a distinct advantage over known devices in optimizing the efficiency of transitioning fluid pressure into P-wave energy, in concurrence with the teachings of integrated geometry and harmonic physics.

In the exemplary embodiments depicted, for example FIG. 6, two ports are employed to keep the pressure in an annulus between the stator and rotor balanced and thus the pressure is released twice in each complete rotation (360°) of the rotor 145; where the ports 146, 147 are closed for about 170° and opened for about 10° of each half-rotation. Moreover, the effective area of the port or opening (e.g., axial length×rotational length), in conjunction with the accumulator size and pressure, govern the pressure drop over each discharge cycle. It is also believed that a wider or a longer slot, all other aspects being constant, will reduce the average pressure in the accumulator.

Figure 8:
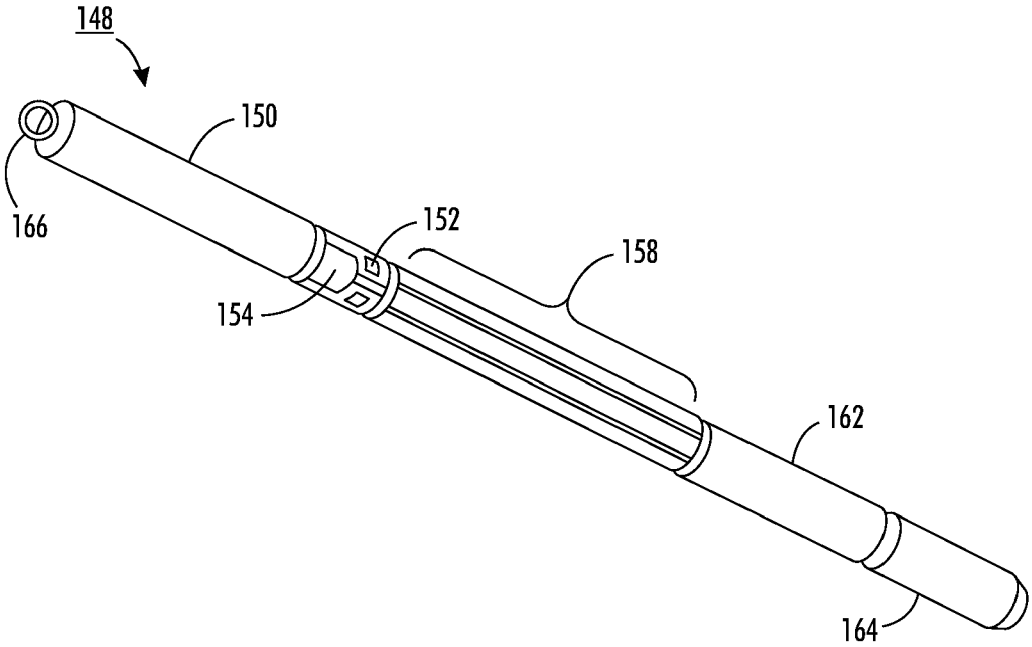
FIG. 8 is a view of a hydraulic transducer seismic wave generator.

In an alternative embodiment, acoustic generator 148, as shown in FIG. 8, transfers pressure indirectly into the well bore or the surrounding fluid (e.g., water and/or oil) via radiator structure 158. The transducer includes a plurality of longitudinal radiators 172 positioned radially about hydraulic pistons 160. The radiators have expansion joints that include some form of material(s) that are suitable for repeated expansion/contraction of the inter-radiator joint. Generator 148 further comprises pressure compensation chamber 150, which serves to equalize the interior pressure to the exterior ambient pressure and also establishes the minimum hydraulic pressure to the intake of the pump in the hydraulic unit 162 as fluid pressure is released by way of servo valve 154, through passage 152, to pistons 160. At the distal end of generator 148 is a submersible motor 164 that is required to drive hydraulic unit 162. The hydraulic unit comprises a fluid reservoir, filter, pump, relief valve, thermal radiator and a reservoir, all of which are not specifically identified, but are believed required to produce sufficient fluid energy to drive the multi-piston actuator of FIG. 11 at a sustained or specific frequency.

Figure 9:
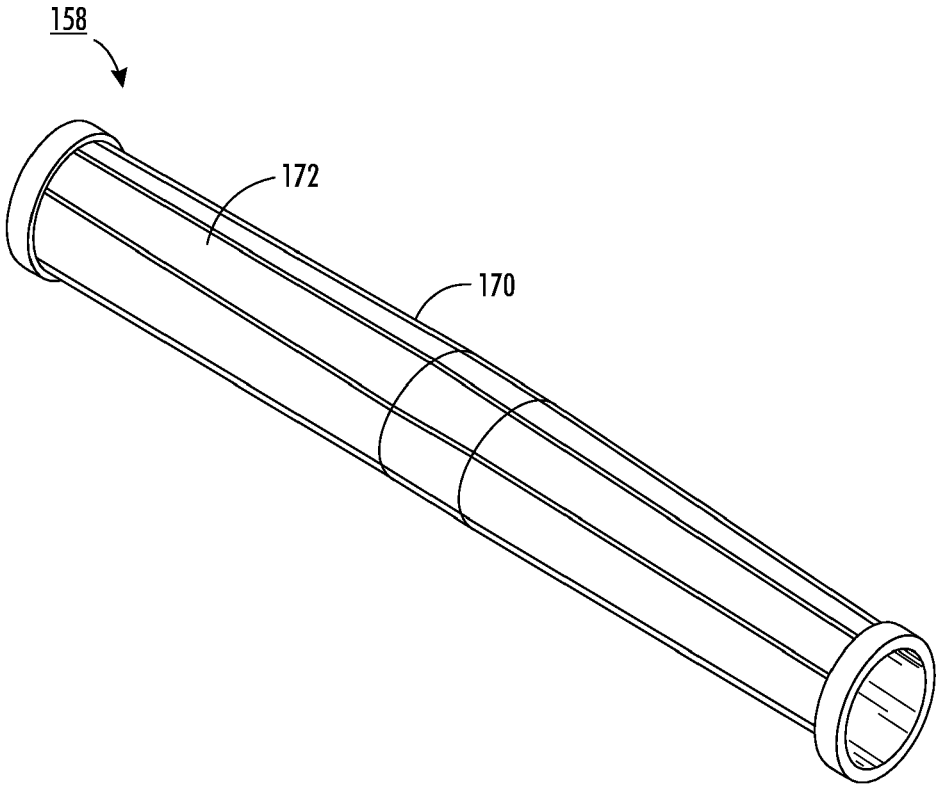
FIG. 9 is an enlarged view of the radiating structure of the transducer shown in FIG. 8.
Figure 10:
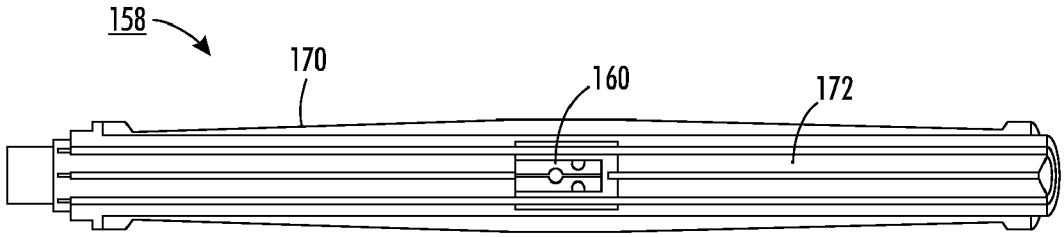
FIG. 10 is a cross sectional view of the transducer with the pistons.
Figure 11:
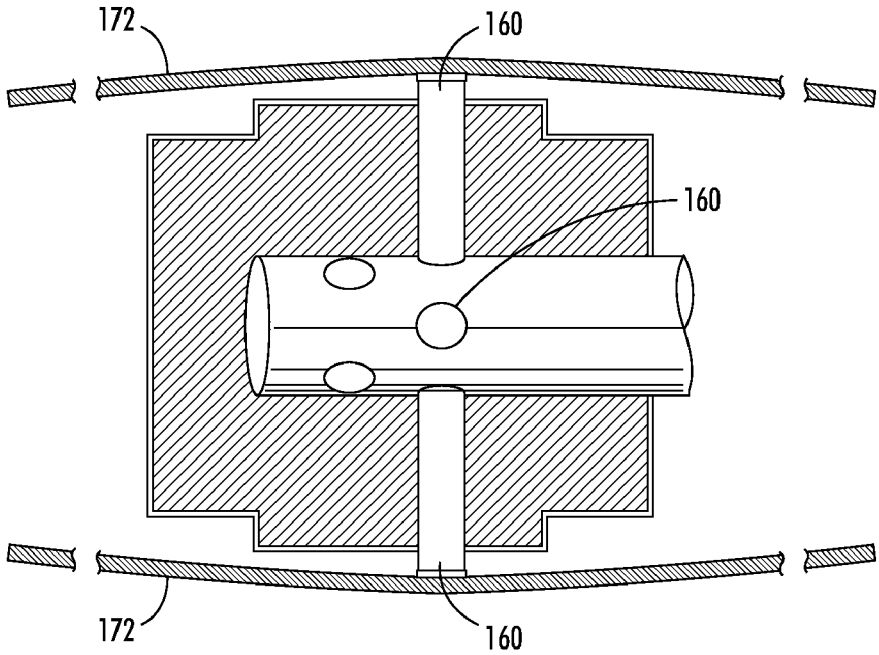
FIG. 11 is an enlarged view of the pistons shown in FIG. 10.
Figure 12:
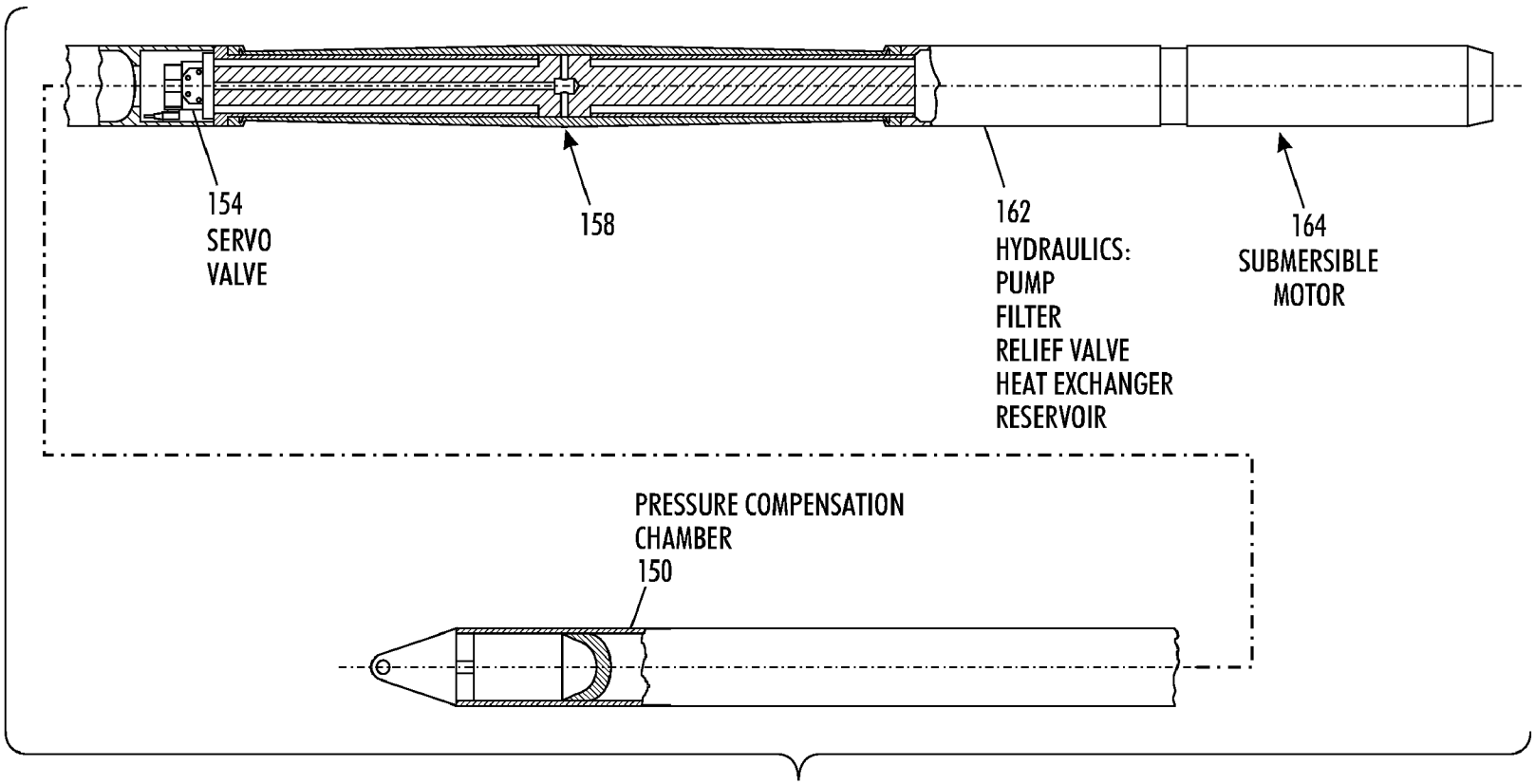
FIG. 12 is a supplemental engineering drawing of the transducer of FIG. 8.
Figure 13:
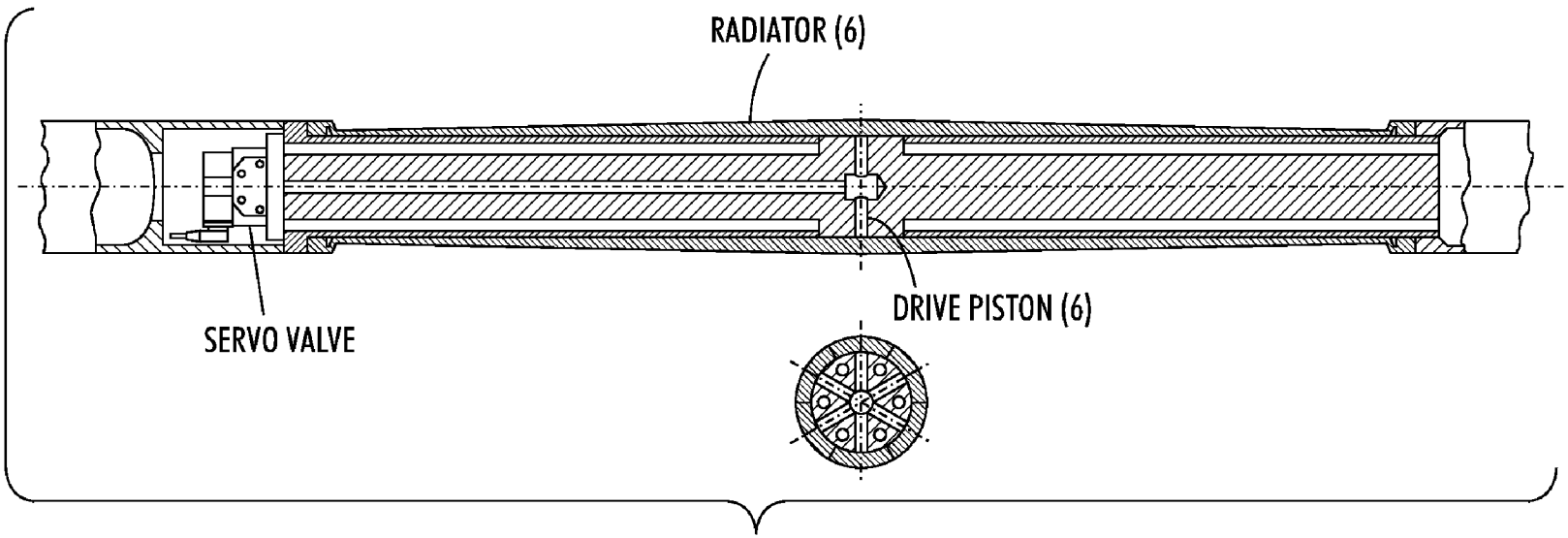
FIG. 13 is a supplemental engineering drawing of the radiator structure of FIG. 12.

Referring now to FIGS. 9-11, radiator structure 158 is shown having six radiators 172, each being commonly attached at the proximal and distal ends and further having six movable pistons 160 individually associated with each radiator 172. To prevent contamination of radiator structure 158 an elastic material forms boot 170 thereby providing a barrier to the surrounding medium. Radiator structure 158 directly displaces a volume of liquid within the well bore at a frequency and velocity determined by the actuation of servo valve 154. The subsequent isotropic pressure wave is therefore generated by the mechanical motion of radiators 172 as applied to fluid(s) 104, 106 contained within the borehole. The resulting hydrodynamic seismic wave from radiator structure 158 is believed to generate a sufficient seismic wave to dislodge and subsequently coalesce oil droplets from the pore channels into larger droplets that become mobile due to their increased mass and therefore begin to move into existing flow streams within the fractures of the strata.

Figure 14:
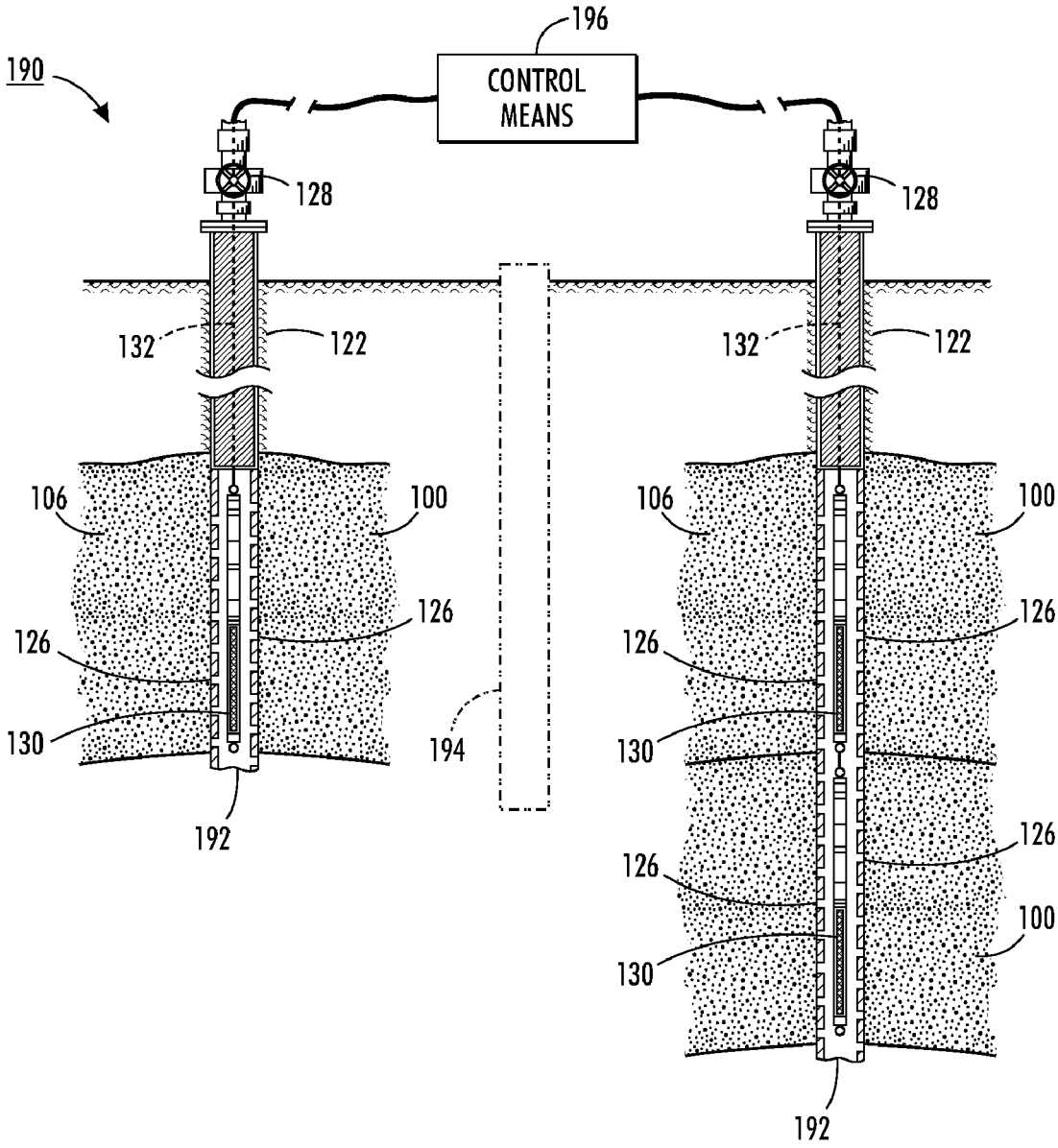
FIG. 14 illustrates an embodiment with a plurality of acoustic generators in an oil field.

Although the acoustic wave generating embodiments described above depict the use of a single apparatus in a borehole within an oil reservoir, it is contemplated that a plurality of acoustic generators could be used in an oil field 190 to produce seismic wave stimulation to further induce oil mobility as depicted in FIG. 14. This system of generators for in-situ seismic stimulation would include strategic positioning of a plurality of generators 130 within various boreholes 192 of the reservoir so as to induce and direct an oil flow towards a production well bore 194 using an overall control means 196 that is principally reliant on the resonant frequency of the reservoir. Feedback for the optimization of the oil reclamation process is ultimately dependant on the actual increase in oil availability or output. Additionally more than one acoustic generator could be placed in tandem within a single borehole (rightmost side of FIG. 14), thereby increasing the available seismic energy in a specific borehole location, if required. Additionally, the various pressure waves from a plurality of acoustic generators can be positioned and phased so as to produce an amplified effect at a certain location(s) within the oil field.

It will be appreciated that various of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. An apparatus for generating acoustic waves with a medium to stimulate oil recovery within an oil reservoir, comprising:

an elongated and generally cylindrical housing suitable for passing through a borehole;

an accumulator;

a pump;

an energy transfer section, wherein the energy transfer section is inclusive of the pressure transfer valve and further includes;

a motor;

a rotor having an input and output port; and a stator having a corresponding port whereby fluid energy is transferred upon alignment of said rotor and stator ports; and a pressure transfer valve, wherein the pump pressure is stored within said accumulator and subsequently transferred, thereby releasing seismic wave energy into the fluid surrounding the apparatus.

2. A method for generating seismic pressure waves within an oil saturated strata, comprising:

placing an acoustic wave generator in contact with a fluid within the strata;

accumulating fluid pressure energy within the acoustic wave generator; and systematically releasing and transferring pressure energy with said generator to create wave energy that is transferred by the fluid into a porous medium of the strata, wherein releasing and transferring energy is accomplished using a rotary valve generator, whereby the relative relationship of a rotor to a stator controls the release and transfer of a systematic pressure pulse to create seismic pressure wave energy.

3. The method of claim 2 whereby a time/energy waveform is a direct function of the geometric profile of the orifice within the stator and rotor and the subsequent rotational alignment thereof.

4. The method of claim 2 whereby the frequency of said systematic release and transfer of said pressure into the oil saturated strata is controlled as a function of the rotational speed of said rotor.

5. The method of claim 2 whereby the frequency of said systematic release and transfer of said pressure into an oil saturated strata is determined by the resonant frequency of the reservoir.

* * * * *